US005414888A

United States Patent [19]

Irwin

[11] Patent Number: 5,414,888

[45] Date of Patent: May 16, 1995

[54] GRIP HANDLE CHUCK

[75] Inventor: Lawrence F. Irwin, Los Angeles, Calif.

[73] Assignee: Augerscope, Inc., Sylmar, Calif.

[21] Appl. No.: 264,899

[22] Filed: Jun. 24, 1994

[51] Int. Cl.[6] ..... B09B 9/02

[52] U.S. Cl. ..... 15/104.33; 279/50; 279/57; 279/74

[58] Field of Search ..... 15/104.33; 279/50, 57, 279/74

[56] References Cited

U.S. PATENT DOCUMENTS 3,449,782 6/1969 Hunt ..... 15/104.33

4,361,924 12/1982 Irwin ..... 15/104.33

*Primary Examiner*—Edward L. Roberts, Jr.

*Attorney, Agent, or Firm*—J. E. Brunton

[57] ABSTRACT

An improved plumbers' tool of the type employing a helically wound coiled spring which is controllably inserted into waste lines to remove blockages. In operating the tool of the invention, a storage drum from which the clean-out spring is payed out is rotated, usually by a small electric motor, and the spring is clamped in a chucking mechanism so as to rotate with the housing. The improvement of the present tool resides in the provision of a unique actuating mechanism which provides a substantial mechanical advantage that enables the operator, using only one hand to grip a forwardly positioned stationary handle with the fingers and move a pivotally movable, rearwardly positioned handle with the heel of the hand to cause the chucking mechanism to positively engage the coiled spring in a manner to prevent slippage even under severe torque loading conditions.

9 Claims, 3 Drawing Sheets

GRIP HANDLE CHUCK

BACKGROUND OF THE INVENTION

1. Field of the Invention

The present invention relates generally to plumbers' tools of the type employing a helically wound coiled spring or "snake" which is rotated and inserted into waste lines to remove blockages. More particularly, the invention concerns an improved device for pressurally gripping the coiled spring to cause its rotation as the casing containing the spring is rotated by an electric motor.

2. Discussion of the Prior Art

One of the most successful motor driven prior art portable plumbing tools ever developed is the tool described in U.S. Pat. No. 3,449,782. An improvement upon this device is described and claimed in U.S. Pat. No. 4,361,924 issued to the present inventor. The invention described herein is an improvement on the device of U.S. Pat. No. 4,361,924.

The tool of the present invention comprises a hand-held motor, a coiled spring, a storage housing for housing the coiled spring, and a manually operated chuck means through which the spring passes.

Several variations of devices of the general type herein described have been suggested. A great many of these prior art devices are difficult to operate principally because of a faulty design of the actuating means by which the chuck is moved into and out of gripping engagement with the spring. Unless this actuating means is properly designed, the operator cannot satisfactorily regulate the pressure being applied to the spring to controllably cause its rotation as the storage housing is rotated. If too much pressure is applied to the spring, the motor will become overloaded and the tool will fail to function properly creating a possibly dangerous situation. If too little pressure is applied to the spring, slippage will result and the spring will not rotate.

While devices of the previously mentioned patents were far superior to any devices in competition therewith, the actuating means of these devices did not enable the effortless and smooth actuation of the chuck assembly that is possible with novel construction of the present invention. More particularly, the device of the present invention overcomes the drawbacks of the prior art predecessor devices by providing a unique actuating means which permits positive actuation of the chuck using the heel of the hand rather than the fingers thereby increasing ease of operation as well as positive controllability of the tool.

SUMMARY OF THE INVENTION

It is an object of the present invention to provide a novel and improved means for gripping an elongated helically coiled spring in a device for housing and rotating the spring.

It is another object of the invention to provide a novel and improved construction which overcomes the disadvantages of prior constructions and in which there is provided a chuck operating means that can be easily, smoothly and effortlessly operated with one hand by a squeezing action on a novel grip having a stationary forward portion and a pivotally movable rearward portion.

Another object is to provide a device of the aforementioned character which can readily be operated by applying controllable squeezing pressure with either hand.

A further object is to modify the actuating lever design shown in U.S. Pat. No. 4,361,924 to provide a unique construction which, due to the construction of the novel pivoting yoke of the device and the lever action which it provides, makes it possible for the operator to exert a positive and readily controllable gripping pressure on the movable portion of the handle grip using the heel portion of the hand while gripping the forward stationary portion of the handle grip with the fingers.

DESCRIPTION OF ONE FORM OF THE INVENTION

Figures 1, 2:
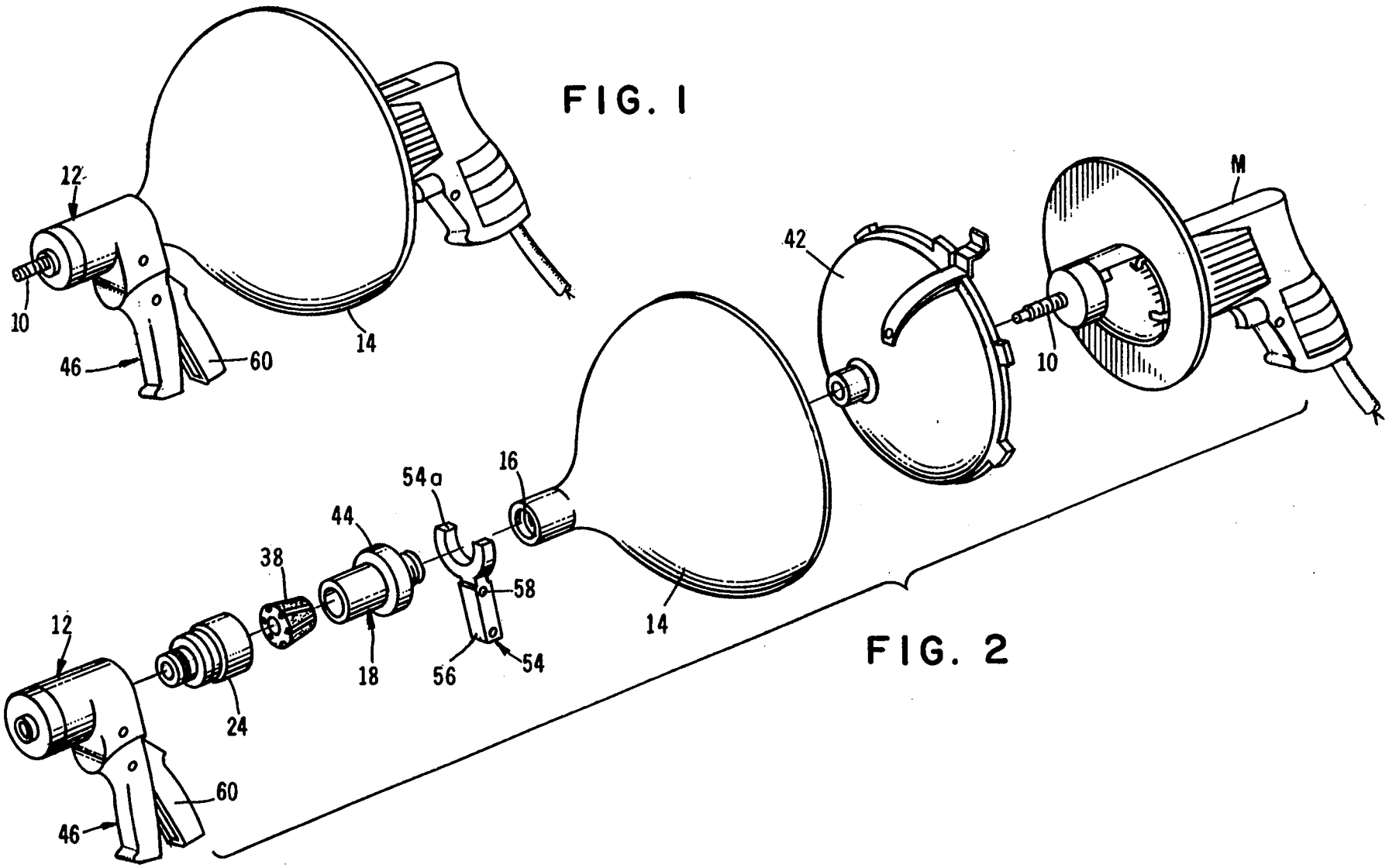
FIG. 1 is a generally perspective view of the assembled device of the invention.
FIG. 2 is an exploded view of the device shown in FIG. 1.
Figure 3:
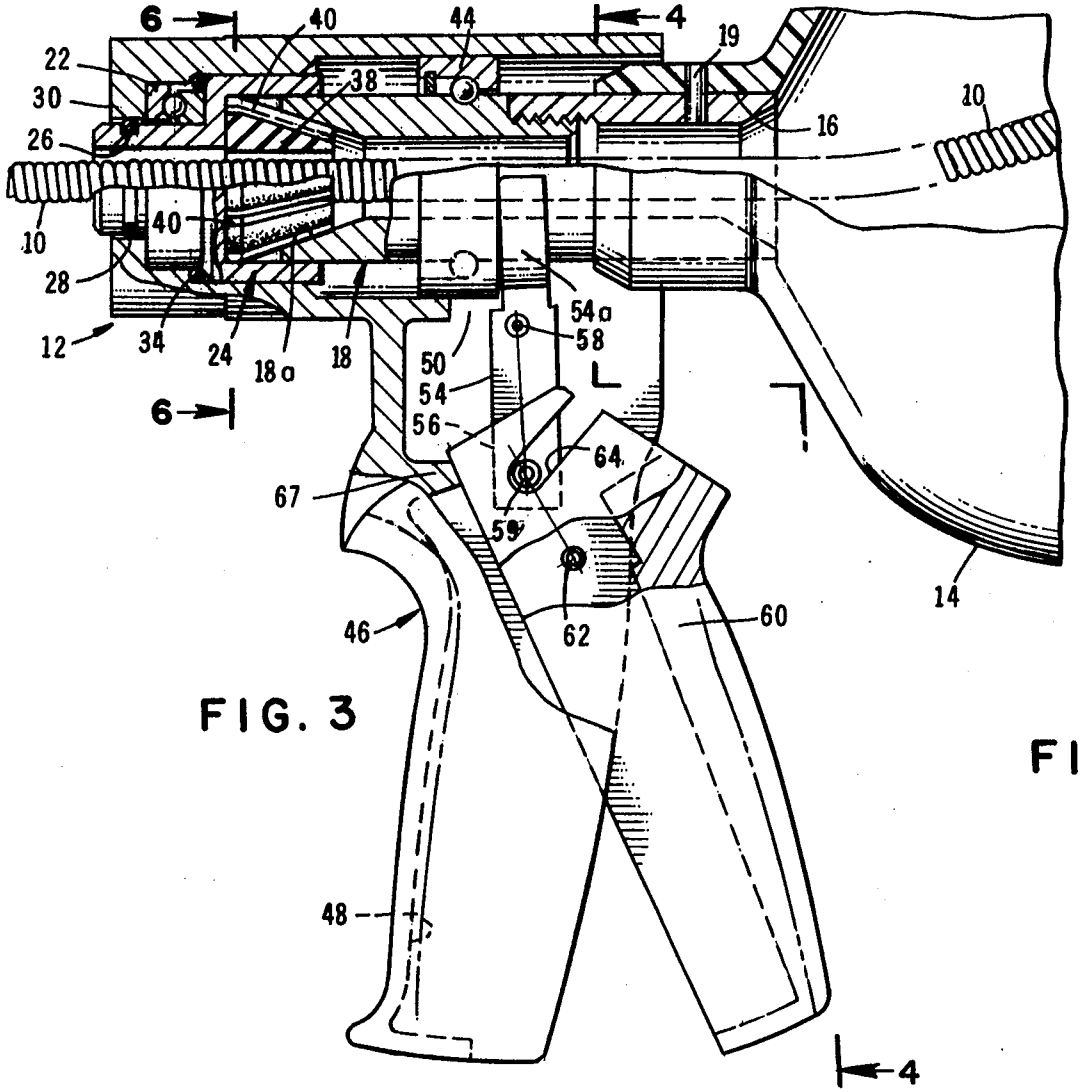
FIG. 3 is an enlarged, fragmentary side-elevational view, partly in cross section, showing the device in a normal, at-rest position.

Referring to the drawings and particularly to FIGS. 1 and 2, the sewer clean-out tool of the present form of the invention comprises an elongated coiled spring 10 extending axially of the body 12 of the device. The coiled spring is payed out from a spring housing 14 which is adapted to contain the spring 10 in a coiled configuration when the tool is not in use. Spring housing 14 is provided with an opening 16 at one side thereof for passage of the coiled spring 10. Referring also to FIG. 3, it can be seen that a tubular spindle 18 projects forwardly of housing 14. Spindle 18 is received within housing 12 and is provided at its forward end with a wedge face 18*a*. Spindle 18 is secured to the housing 14 by means of pins 19. With his construction, the spindle is, in effect, a forward extension of the spring housing 14.

A main thrust bearing 22 is mounted proximate the forward end of chuck body 10 and is held in position by a spindle cap 24 which is received within body 10. A groove 26 provided in spindle cap 24 accommodates an elastomeric O-ring 28 which sealably engages a forward flange 30 provided on cap 24. A second O-ring 34 is carried within body 12 and bears against the spindle cap and also against thrust bearing 22.

Mounted within spindle cap 24 is a chuck collet 38. Collet 38 is frustoconical in shape and is provided with a plurality of circumferentially spaced steel inserts 40 which are adapted to engage wedge surface 18*a* of spindle 18 when the spindle is moved forwardly of body 12.

In the embodiment of the tool shown in the drawings, a hand-held motorized drill "M" is mounted onto housing 14 by means of an adapter unit 42 so that housing 14 can be rotated when the drill motor is operated. Because the coiled spring 10 meets considerable resistance as it is fed through a clogged waste pipe or the like, it is necessary to provide means to securely grip the coiled spring so that, during the line cleanout operation, it will be locked with the housing and rotate therewith without danger of slipping. The previously identified chuck collet 38 comprises a part of said means.

Figure 5:
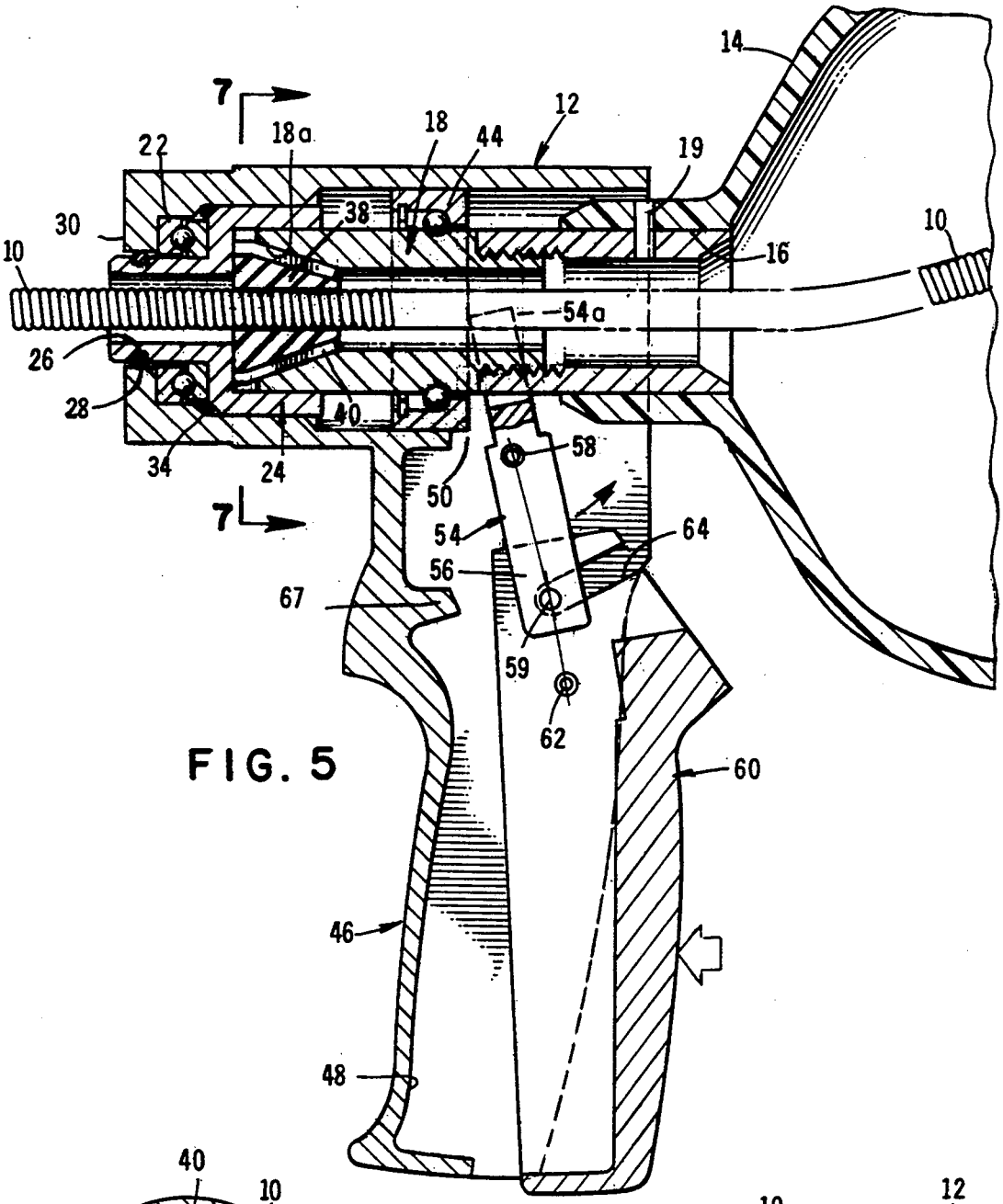
FIG. 5 is a side-elevational cross-sectional view similar to FIG. 3 but showing the device in a feed mode with the spring gripping chuck contracted about the coil spring.
Figure 6:
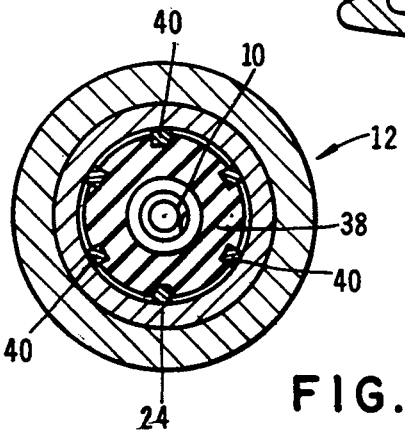
FIG. 6 is a cross-sectional view taken along lines 6—6 of FIG. 5.
Figure 7:
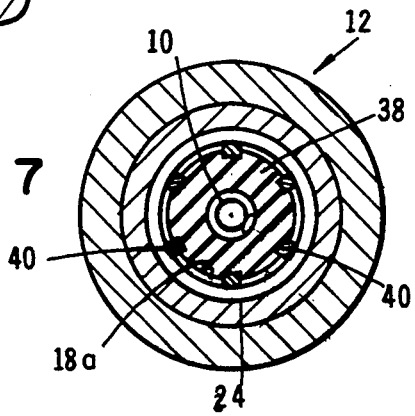
FIG. 7 is a cross-sectional view taken along lines 7—7 of FIG. 5.

When the tool is at rest, the component parts thereof are as shown in FIGS. 3 and 6. However, upon activation of the device to cause spindle 18 to be moved forwardly toward the collet, the latter will be compressed so as to move into gripping engagement with the coiled spring in the manner shown in FIGS. 5 and 7. To actuate the device, there is provided a uniquely designed, improved actuating means which functions to effortlessly impart relative movement between the spindle and the collet chuck in a manner to cause the chuck to controllably contract. The actuating means here operates through a radial thrust bearing 44 which rotatably supports the spindle and, in a manner presently to be described, imparts axial movement thereto upon operation of the actuating means.

In the present form of the invention, the novel actuating means comprises a first stationary handle 46 formed as an integral part of the chuck body housing 10. Handle 46 extends radially downwardly and is provided with an elongated, rearwardly facing, channel-shaped opening 48 (FIG. 4) which defines an opening 50 in body 10. Opening 50 is configured to partially receive a manually operable lever means which functions to impart forward movement to the thrust bearing 44 to the spindle 18. In the embodiment of the invention shown in the drawings, the lever means comprises an actuating member 54 having a generally yoke shaped inner end **54*a* that extends through opening 50 in body 12 for pressural engagement with the thrust bearing 44. The outer or lower end 56 of the actuating member projects downwardly into handle 50 in the manner shown in FIG. 3. Actuating member 54 pivots about a pivot pin 58 (FIG. 4) which extends transversely of body 12 and is pivotally movable from the first, at rest position shown in FIG. 3 to the second actuating position shown in FIG. 5**.

Figure 4:
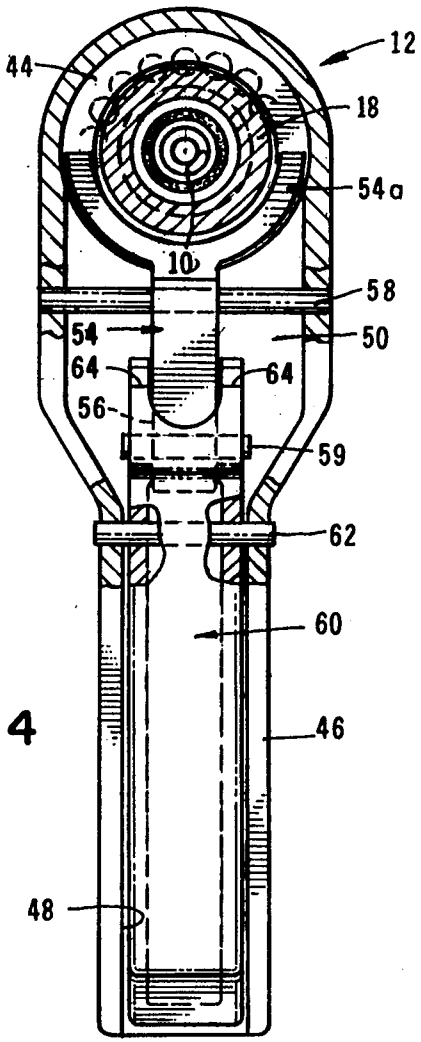
FIG. 4 is a cross-sectional view taken along lines 4—4 of FIG. 3.

An engaging element 59 is provided proximate the lower end of member 54 and extends transversely of lower end 56. In operation of the tool, this engaging element is engaged by the engaging means of the second or movable handle 60 of the device. As best seen in FIG. 4, handle 60 is pivotally connected to handle 46 and is adapted to pivot about a transversely extending pivot pin 62 carried by handle 46. In the instant form of the invention, the engaging means comprises a pair of slots 64 provided proximate the upper end of handle 60.

When the tool is in an at-rest configuration, as shown in FIG. 3, then upper end of handle 60 is disposed within opening 48 of handle 46 and rests against oppositely disbursed, spaced apart protuberances 67 provided on handle 46. In operating the device, the user grips handle 46 with the fingers of one hand and engages movable handle 60 with the inner heel portion of the hand. After the drill motor is energized, pressure exerted on handle 60 with the heel of the hand causes it to move forwardly into the rearwardly facing channel 48 formed in stationary handle 46. During this movement, the engaging means of handle 60 will move actuating member 54 from the first position shown in FIG. 3 to the second feed or actuation position shown in FIG. 5. This forward movement of handle 60 causes the upper end of portion **54*a* of member 54 to pressurally engage thrust bearing 44 moving the forward tapered end of the spindle into engagement with members 40 of the collet chuck. This, in turn, causes the chuck to contract and positively engage the coil spring in the manner shown in FIGS. 5 and 7**.

The unique arrangement and lever action type construction of the actuating means of the tool of the present invention provides a substantial mechanical advantage which enables the operator to use the heel portion of the hand to effortlessly apply substantial pressure to the thrust bearing causing the chuck to grip the spring with ample force to preclude slippage even under the worst of conditions. With the substantial mechanical advantage achievable by the lever means being acted upon by the heel portion of the hand, even an operator with a very weak grip can efficiently operate the tool with either his left or right hand.

Having now described the invention in detail in accordance with the requirements of the patent statutes, those skilled in this art will have no difficulty in making changes and modifications to the individual parts or their relative assembly in order to meet specific requirements or conditions. Such changes and modifications may be made without departing from the scope and spirit of the invention, as set forth in the following claims.

I claim:

1. A sewer clean-out tool, comprising:

(a) an elongated coiled spring;

(b) a spring housing adapted to contain said coiled spring when not in use, said housing having an opening at one side thereof for the passage of said coiled spring;

(c) a tubular spindle projecting forwardly from said housing axially of the opening, said spindle having a wedge shaped face;

(d) a tubular chuck body housing surrounding said spindle;

(e) a thrust bearing mounted within said chuck body housing for reciprocal movement therewithin, said thrust bearing being adapted to rotatably support said spindle and to impart axial movement thereto;

(f) a contractable collet chuck carried within said chuck body housing, said chuck having a wedge shaped face adapted to mateably engage said wedge shaped face of said spindle upon relative axial movement between said spindle and said chuck to contract said chuck;

(g) actuating means for imparting relative movement between said spindle and said collet chuck to cause said chuck to contract, said actuating means comprising a first stationary handle formed as a part of said chuck body housing and extending radially thereof in the region of said opening, said handle having an elongated channel-shaped, rearwardly facing opening therein, said actuating means further comprising a mutually operable lever means for causing movement of said thrust bearing, said lever means being partially receivable in said channel shaped opening of said handle and including:

(i) an actuating member connect to said chuck body housing, said actuating member having an inner end engageable with said thrust bearing and an outer end projecting into said first stationary handle, said inner end having an engagement element;

(ii) a second handle pivotally connected to said first handle for pivotal movement from a first rearward position to a second forward position, said second handle having engaging means for engaging said engagement element of said actuating member to cause said actuating member to impart movement to said thrust bearing.

2. The sewer clean-out tool as defined in claim 1 in which said engagement element comprises a pin extending transversely of said actuating member and in which said engaging means comprises a slot formed in said second handle for slidably receiving said engagement element.

3. The sewer clean-out tool as defined in claim 1 in which said second handle is receivable within said elongated channel-shaped, rearwardly facing opening of said first handle as said second handle is moved toward said second position.

4. The sewer clean-out tool as defined in claim 3 in which said inner end of said actuating member is moved forwardly toward said collet chuck and in which said outer end of said actuating member is moved rearwardly upon movement of said second handle toward said second position.

5. A plumbers' tool of the character which uses an elongated coiled spring and which includes a housing in which the coiled spring can be coiled, said housing having an opening at one side for the passage of the spring, a tubular spindle projecting from the housing axially of the opening a tubular chuck body housing surrounding said spindle, a main thrust bearing mounted in the outer end of said chuck body beyond the end of said spindle, a collet chuck between said bearing and said spindle, said spindle and collet chuck having interengaging wedge faces whereby to contract said chuck upon relative movement of said bearing and spindle toward said other, a radial thrust bearing on said spindle within said chuck body housing and spaced axially inward of said thrust bearing, said chuck body housing and having an opening intermediate its ends in the region of said radial thrust bearing, the improvement comprising actuating means for actuating said chuck including:

(a) a stationary handle formed as a part of said chuck body housing and extending radially thereof in the region of said opening, said handle being channel-shaped in cross section and open on its edge facing rearwardly toward said housing; and (b) a manually operable lever means operably associated with said stationary handle for causing movement of said thrust bearing, said lever means comprising:

(i) an actuating member having an inner end engageable with said thrust bearing and an outer end extending into said stationary handle, said actuating member being pivotable about a pivot pin extending transversely of said stationary handle between first and second positions; and (ii) a movable handle pivotally connected to said stationary handle for movement between a first rearward position and a second forward position, said movable handle including engaging means for moving said actuating member between said first and second positions.

6. A plumbers' tool as defined in claim 5 in which said lever means further includes a transversely extending engagement element adapted to be engaged by said engaging means of said movable handle.

7. A plumbers' tool as defined in claim 6 in which said engaging means comprises a slot formed in said movable handle for receiving said engagement element.

8. A plumbers' tool of the character which uses an elongated coiled spring and which includes a housing in which the coiled spring can be coiled, said housing having an opening at one side for the passage of the spring, a tubular spindle projecting from the housing axially of the opening a tubular chuck body housing surrounding said spindle, a main thrust bearing mounted in the outer end of said chuck body beyond the end of said spindle, a collet chuck between said bearing and said spindle, said spindle and collet chuck having interengaging wedge faces whereby to contract said chuck upon relative movement of said bearing and spindle toward said other, a radial thrust bearing on said spindle within said chuck body housing and spaced axially inward of said thrust bearing, said chuck body housing and having an opening intermediate its ends in the region of said radial thrust bearing, the improvement comprising actuating means for actuating said chuck including:

(a) a stationary handle formed as a part of said chuck body housing and extending radially thereof in the region of said opening, said handle being channel-shaped in cross section and open on its edge facing rearwardly toward said housing; and (b) a manually operable lever means operably associated with said stationary handle for causing movement of said thrust bearing, said lever means comprising:

(i) an actuating member having a generally yoke shaped inner end engageable with said thrust bearing and an outer end extending into said stationary handle, said actuating member being pivotable about a pivot pin extending transversely of said stationary handle between first and second positions;

(ii) an engagement pin connected to said inner end of said actuating member and extending transversely thereof; and (iii) a movable handle pivotally connected to said stationary handle for movement between a first rearward position and a second forward position, said movable handle having a slot formed therein for closely receiving said engagement pin.

9. A tool as defined in claim 8 in which said stationary handle further includes an inwardly extending protuberance engagable by said movable handle.

* * * * *